US008313049B2

(12) United States Patent
Xu

(10) Patent No.: US 8,313,049 B2
(45) Date of Patent: Nov. 20, 2012

(54) SHOWER FAUCET

(75) Inventor: Feng Xu, Guangdong (CN)

(73) Assignee: Globe Union Industrial Corp., Taichung (TW)

( * ) Notice: Subject to any disclaimer, the term of this patent is extended or adjusted under 35 U.S.C. 154(b) by 508 days.

(21) Appl. No.: 12/724,714

(22) Filed: Mar. 16, 2010

(65) Prior Publication Data

US 2011/0226876 A1 Sep. 22, 2011

(51) Int. Cl.
*B05B 1/14* (2006.01)

(52) U.S. Cl. ..... 239/558; 239/447; 239/448; 239/449; 239/562; 239/530; 239/280; 239/281; 239/525; 239/587.1; 239/588; 239/443

(58) Field of Classification Search ..... 239/600, 239/447, 443, 448, 449, 530, 280, 281, 525, 239/587.1, 588, 562, 446
See application file for complete search history.

(56) References Cited

U.S. PATENT DOCUMENTS 5,158,234 A * 10/1992 Magnenat et al. ..... 239/449
6,045,062 A * 4/2000 Bosio ..... 239/443
2005/0258274 A1* 11/2005 Wang ..... 239/393
* cited by examiner

*Primary Examiner* — Dinh Q Nguyen

(57) ABSTRACT

A shower faucet includes a housing having a press bar axially connected; a tube member installed in the housing and including a seat having a second room to distributing water and a displace room; a distributing valve core pushed to move between a higher and a lower positions of the second room to generate a first and a second waterings; a button element biased against by the press bar to actuate a rotary positioning member to engage with the distributing valve core to generate the second watering, wherein the positioning member is retained on ratchet members of the displace so that the second watering is kept without pressing the press bar continuously, a resilient element used to push the distributing valve core so that the positioning member is rotated and pushed to disengage from the ratchet members, such that watering levels are switched by pressing the press bar easily.

13 Claims, 15 Drawing Sheets

SHOWER FAUCET

BACKGROUND OF THE INVENTION

1. Field of the Invention

The present invention relates to a shower faucet.

2. Description of the Prior Art

A conventional shower faucet includes a seat having a water distributing room to receive a distributing valve core, and the distributing valve core is controlled to move between at least two different positions, generating different waterings.

Many shower faucets are provided with a watering control structure to switch different watering levels by using double button elements, having inconvenient operation. Furthermore, some shower faucets (such as a shower faucet disclosed in CN Publication No. CN 201265171) is provided to switch watering levels by using a single button element, but the desired watering level has to be kept by pressing the press bar continuously, having inconvenient operation.

In addition, another shower faucet is used to switch watering levels, however when the shower faucet is used at a lower water pressure, the desired watering level can not be kept effectively.

The present invention has arisen to mitigate and/or obviate the afore-described disadvantages.

SUMMARY OF THE INVENTION

The primary object of the present invention is to provide a shower faucet which is capable of overcoming the shortcomings of the conventional shower faucet thereof.

A shower faucet in accordance with the present invention comprises:

a housing including an internal chamber, an inlet end, and an outlet end, and including a press bar disposed on a peripheral wall thereof proximate to the outlet end to be pressed to rotate axially within a predetermined rotating angle;

a tube member installed in the housing, and including a fitting, an inlet pipe, a seat, and a watering disc, wherein the fitting is coupled with an output piping, the inlet pipe is screwed with the fitting;

a seat including a first room to flow water, a second room to distribute water, a displace room, a flowing chamber, a first watering cavity, and a second watering cavity; the first room including an inlet side to connect with an outlet end of the inlet pipe; the second room including an inlet fixed on one side thereof to communicate with the first room, and including a first outlet; a top end of the displace room communicating with a bottom end of the second room, and the displace room including a plurality of ratchet members extending on a lower side thereof, each ratchet member including two adjacent ratchet planes disposed on a top end thereof to define a ratchet ditch, and between any two abutting ratchet members beings defined an axial recess; the flowing chamber being fixed in the displace room and including a bore attached on a top end thereof to communicate with a peripheral side of the bottom end of the second room, and including at least two second outlets arranged around a peripheral side thereof; the first watering cavity communicating with the second room through the first outlet; the second watering cavity communicating with the flowing chamber through the second outlets;

the watering disc engaging with a watering side of the seat, and including a central trench and a peripheral trench mounted on an inner side thereof, the central trench being in communication with the first watering cavity of the seat to obtain a first watering, and the peripheral trench being in communication with the second watering cavity of the seat to achieve a second watering;

the distributing valve core installed in the second room of the seat, and including a first closing portion retained on a top end of an outer wall thereof to close the first outlet of the seat when the distributing valve core is pushed upward to slide, and the bore being in communication with the second room; the distributing valve core also including a second closing portion disposed on a bottom end of an outer peripheral wall thereof so that when the distributing valve core is pushed downward to close the bore of the seat, and the second outlet communicates with the second room;

the resilient element installed at a top end of the distributing valve core relative to a top end of the second room of the seat so as to push the distributing valve core downward;

the rotary positioning member allowing to push the distributing valve core upward, and including a number of engaging tooth members mounted on a middle section thereof to slide vertically along the recesses of the displace room of the seat, and each engaging tooth member including a first inclined tooth plane fixed on a bottom end thereof; wherein the engaging tooth member is pushed upward to disengage from the recess so that the first inclined tooth plane slides into the ratchet ditch to be retained, such that the first closing portion of the distributing valve core is kept closing the first outlet, and when the engaging tooth member is further pushed upward to disengage from the ratchet ditch, it is pushed by the resilient element to rotate so as to disengage from the ratchet member to move toward the axial recess, and when the engaging tooth member is not pushed upward anymore more, it is pushed by the resilient element to move downward along the axial recess so that the second closing portion of the distributing valve core is kept closing the bore;

a button element including a number of sliding members secured on a top end of an outer wall thereof to slide vertically along the axial recesses of the displace room, and including a plurality of conical teeth arranged on the top end thereof to connect with each other, and each conical tooth including a first beveled surface and a second beveled surface, the button element being axially limited to extend downward out of a bottom end of the displace room by ways of an extension which extends from a bottom end of an outer wall of the button element, the extension of the button element being pushed upward by the abutting block which is rotated axially by the press bar of the housing so that the button element slides upward, and the first beveled surface being pushed upward to abut against the first inclined tooth planes of the engaging tooth members of the rotary positioning member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
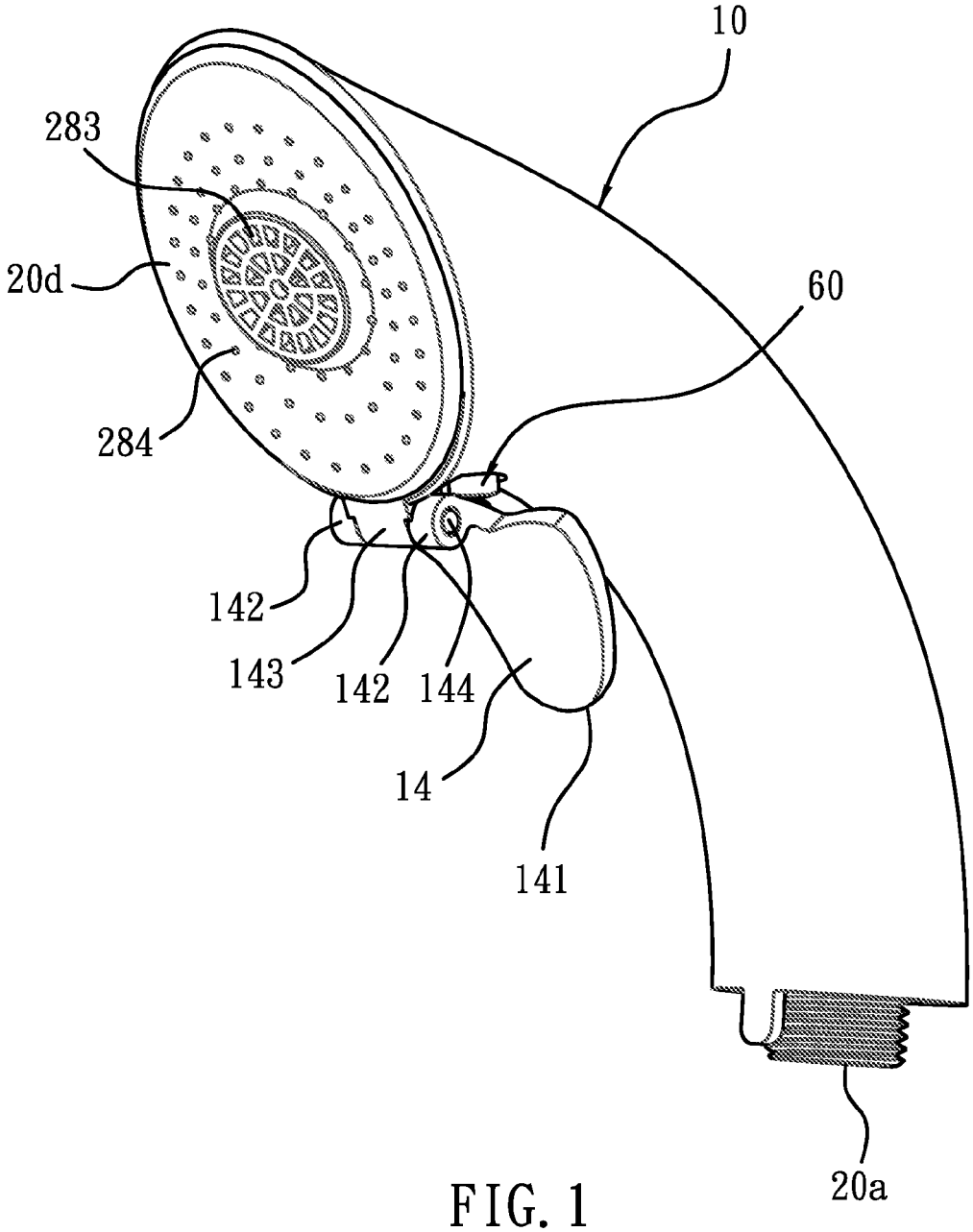
FIG. 1 is a perspective view showing the assembly of a shower faucet in accordance with a preferred embodiment of the present invention.
Figure 2:
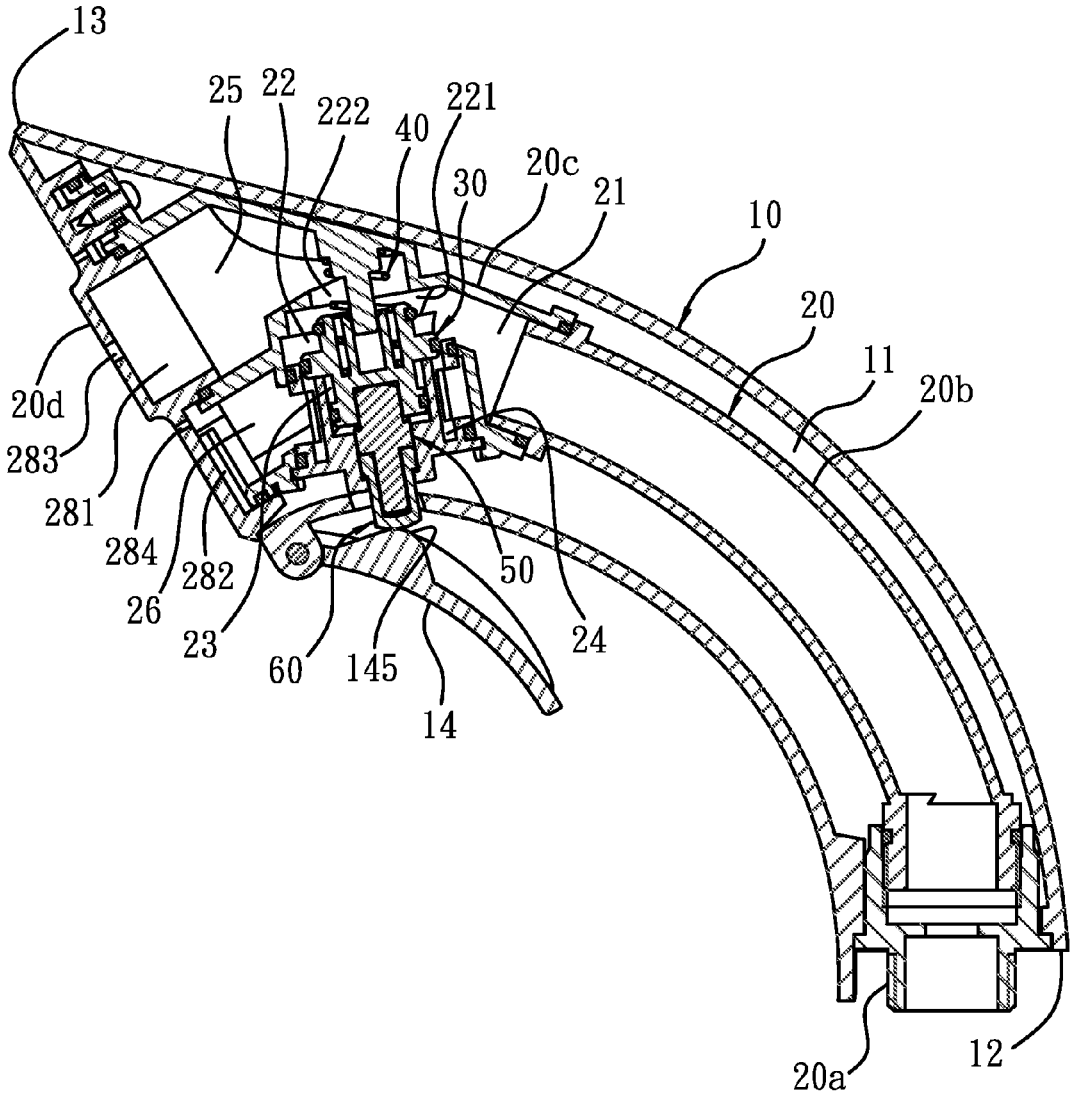
FIG. 2 is a cross sectional view showing the assembly of the shower faucet in accordance with the preferred embodiment of the present invention.
Figure 3:
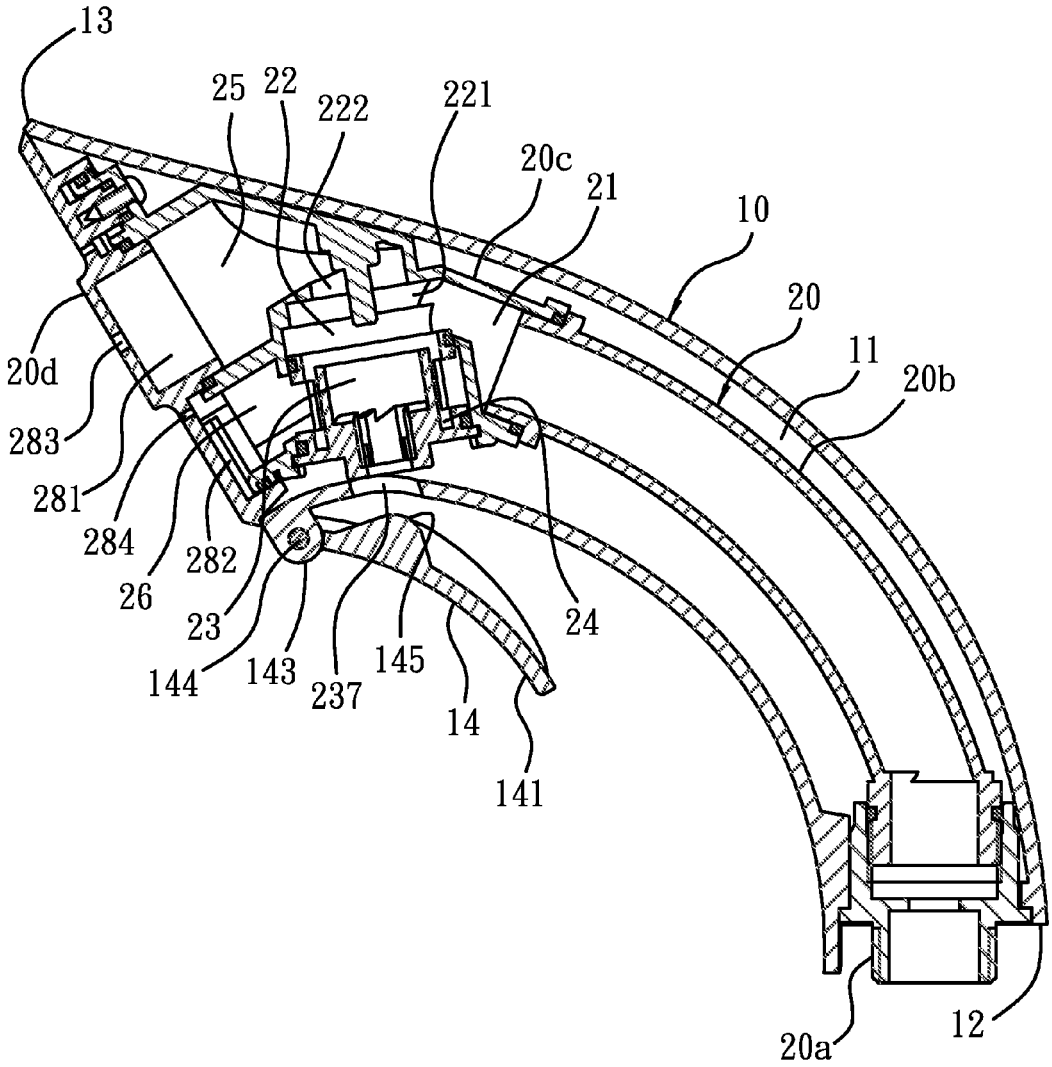
FIG. 3 is a cross sectional view showing the assembly of a housing and a tube member of the shower faucet in accordance with the preferred embodiment of the present invention.

Referring to FIGS. 1-3, a shower faucet according to a preferred embodiment of the present invention comprises a housing 10, a tube member 20, a distributing valve core 30, a resilient element 40, a rotary positioning member 50, and a button element 60.

Figure 14:
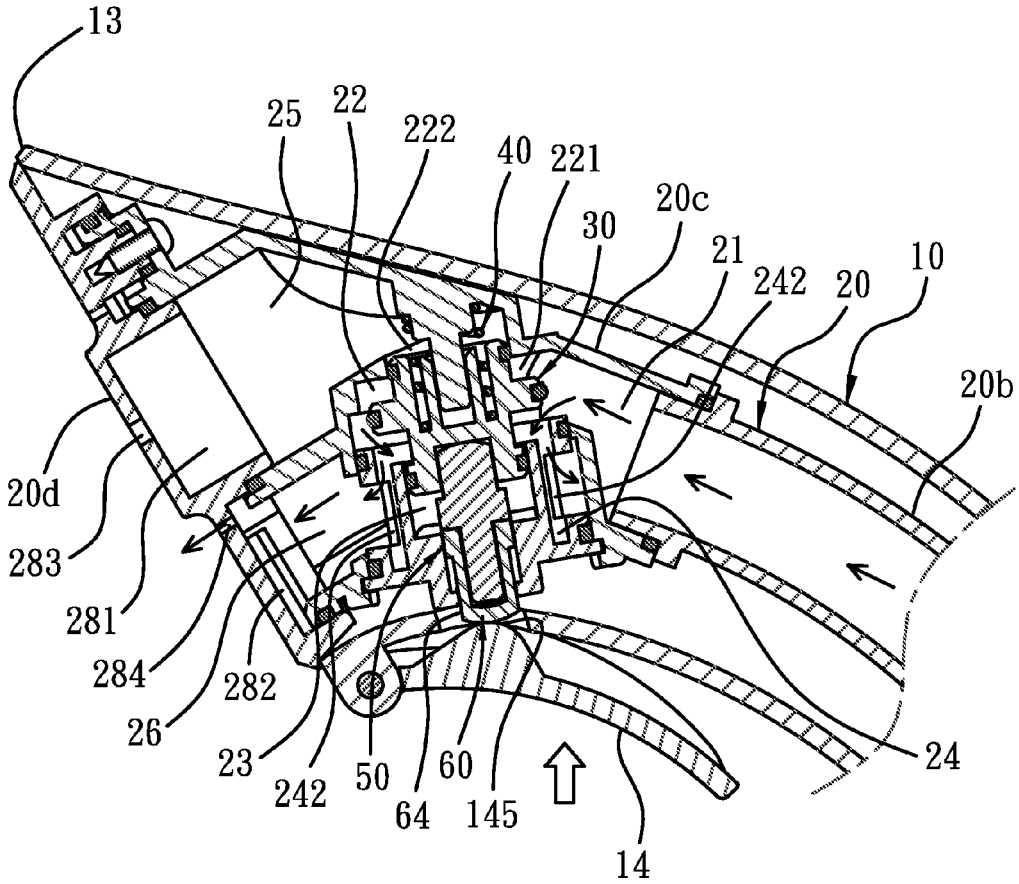
FIG. 14 is another cross sectional view showing the operation of the shower faucet in accordance with the preferred embodiment of the present invention.

The housing 10 includes an internal chamber 11, an inlet end 12, and an outlet end 13, and includes a press bar 14 disposed on a peripheral wall thereof proximate to the outlet end 13 to be pressed to rotate axially within a predetermined rotating angle. The press bar 14 includes a pivoting end and a pressing end 141, and the pivoting end includes two symmetrical axial tabs 142 to connect with a pivoting member 143 by using an axial shaft 144 and to be limited at a predetermined angle, so that when the pressing end 141 is pressed upward as shown in FIG. 14, the press bar 14 rotates in an anti-clock direction and returns to an original position when it is released further. The press bar 14 further includes an abutting block 145 mounted on an appropriate position thereof relative to the peripheral wall of the housing 10.

The tube member 20 is installed in the housing 10, and includes a fitting 20*a*, an inlet pipe 20*b*, a seat 20*c*, and a watering disc 20*d*.

The fitting 20*a* is retained in the inlet end 12 of the housing 10 to couples with an output piping so as to receive water from the output piping.

The inlet pipe 20*b* is screwed with the fitting 20*a* to receive water from the fitting 20*a*.

The seat 20*c* as illustrated in FIGS. 4-7, includes a first room 21 to flow water, a second room 22 to distribute water, a displace room 23, a flowing chamber 24, a first watering cavity 25, and a second watering cavity 26.

The first room 21 includes an inlet side to connect with an outlet end of the inlet pipe 20*b* to receive water from the inlet pipe 20*b*.

The second room 22 includes an inlet 221 fixed on one side thereof to communicate with the first room 21, and includes a first outlet 222 and a guiding portion 223 secured on a top end thereof. In this embodiment, the guiding portion 223 is formed in a rod shape, the second room 22 includes a positioning fence 224 attached around the guiding portion 223.

Figure 7:
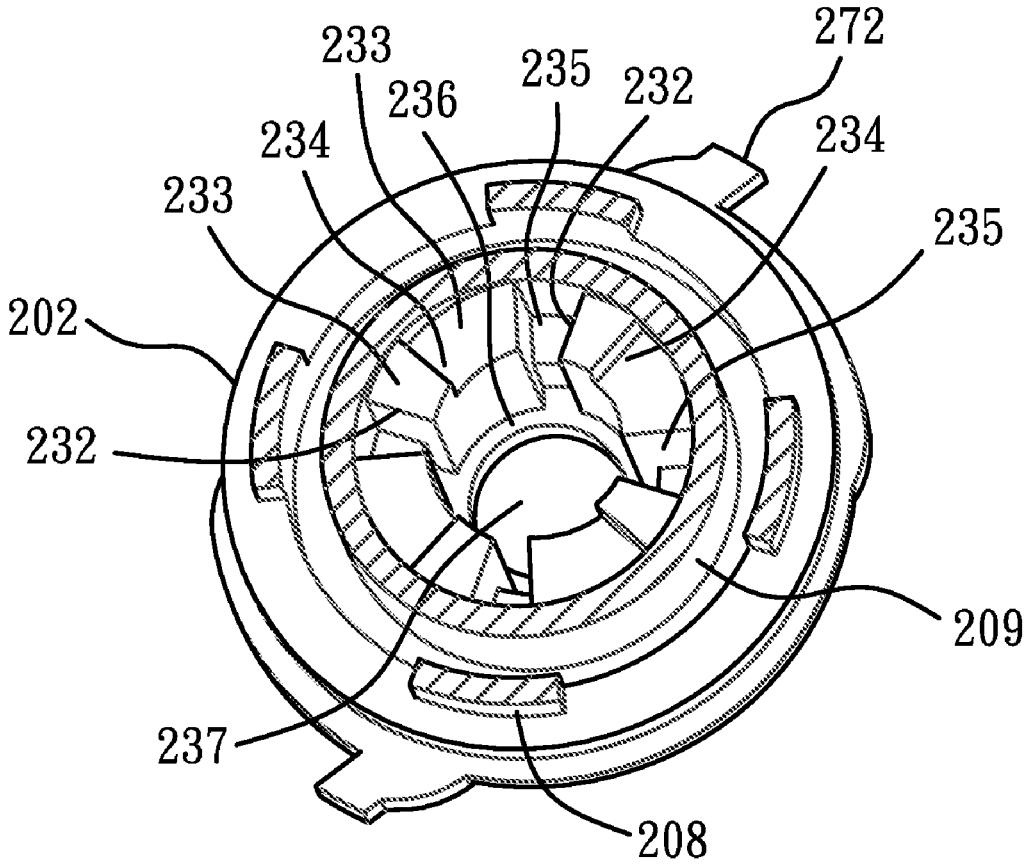
FIG. 7 is a perspective view showing the cross sectional of the seat of the shower faucet in accordance with the preferred embodiment of the present invention.

The displace room 23 includes an orifice 231 formed on a top end thereof to communicate with a bottom end of the second room 22, and includes a plurality of ratchet members 232 extending on a lower side thereof. In this embodiment, there are four ratchet members 232 arranged on the lower side of the displace room 23. As shown in FIG. 7, each ratchet member 232 includes two adjacent ratchet planes 233 disposed on a top end thereof to define a ratchet ditch 234, and between any two abutting ratchet members 232 is defined an axial recess 235, the displace room 23 also includes a bottom wall surface 236 mounted on a bottom end thereof, and the bottom wall surface 236 includes an aperture 237 fixed on a central portion thereof.

The flowing chamber 24 is fixed in the displace room 23, and includes a bore 241 attached on a top end thereof to communicate with a peripheral side of the bottom end of the second room 22, and includes a number of second outlets 242 arranged around a peripheral side thereof.

The first watering cavity 25 is located at an upper side of the tube member 20 to communicate with the first outlet 222.

The second watering cavity 26 is located at a lower side of the tube member 20 to communicate with the second outlets 242.

In this embodiment, the seat 20*c* is comprised of a body 201 and a base 202.

The body 201 is one part of the first room 21, the second room 22, the first watering cavity 25, the second watering cavity 26, the inlet 221, the first outlet 222, and the guiding portion 223, and includes a receiving space 203 formed on a lower side of the second room 22, and the receiving space 203 includes a first opening 204 formed on a bottom end thereof, includes a second opening 205 arranged on one side thereof to communicate with the second watering cavity 26, and the first opening 204 includes two retaining slots 206 symmetrically attached on a peripheral side of a bottom end thereof.

The base 202 is installed in the receiving space 203 of the body 201, and includes a bottom rim 207, and an outer rim 208 and an inner rim 209, both of which extend upward from the bottom rim 207; the outer rim 208 includes two first sealing pads 271 respectively retained on a top and a bottom ends of an outer peripheral side thereof to engage with inner walls of an upper and a lower sides of the receiving space 203 of the body 201, and the outer rim 208 includes two locking members 272 disposed on an outer wall thereof in response to the first sealing pads 271 individually to retain with the retaining slots 206 so that the base 202 is fixed in the body 201.

Between the inner rim 209 and the bottom rim 207 is defined the displace room 23 of the seat 20*c*. A top end of the inner rim 209 is lower than the outer rim 208, and among the inner rim 209, the outer rim 208, and the bottom rim 207 is defined the flowing chamber 24 so that the bore 241 is defined by the inner rim 209 and the outer rim 208, and the second outlets 242 are defined by a plurality of annular mouths arranged on a middle section of the outer rim 208. An internal vacancy of the outer rim 208 below the top end of the inner rim 209 is used to form another part of the second room 22 and to form the complete second room 22 with an inner vacancy of the body 201 which is also one part of the second room 22.

The watering disc 20*d* engages with a watering side of the seat 20*c*, and includes a central trench 281 and a peripheral trench 282 mounted on an inner side thereof, the central trench 281 is in communication with the first watering cavity 25 of the seat 20*c* to receive water from the first outlet 222, and includes a number of central vents 283 fixed on a bottom wall thereof to form a first watering. In this embodiment, the first watering is provided to feed water into a bathtub.

The peripheral trench 282 communicates with the second watering cavity 26 of the seat 20*c* to receive water from the second outlets 242, and includes a plurality of peripheral vents 284 attached on a bottom wall thereof to receive water from the seat 20*c* and to form a second watering. In this embodiment, the second watering is provided to supply showering water.

The distributing valve core 30 is installed in the second room 22 of the seat 20*c*, and includes a sleeve portion 31 formed on a top end thereof. In this embodiment, the sleeve portion 31 is formed in a sliding groove to slide vertically along the rod-shaped guiding portion 223, and includes a first closing portion 32 retained on a top end of an outer wall thereof to close the first outlet 222 of the seat 20*c* when the distributing valve core 30 is pushed upward to slide, and the bore 241 is in communication with the second room 22 as illustrated in FIG. 14. The first closing portion 32 is slid into the first outlet 222 to engage with an inner peripheral wall of the first outlet 222.

Figure 11:
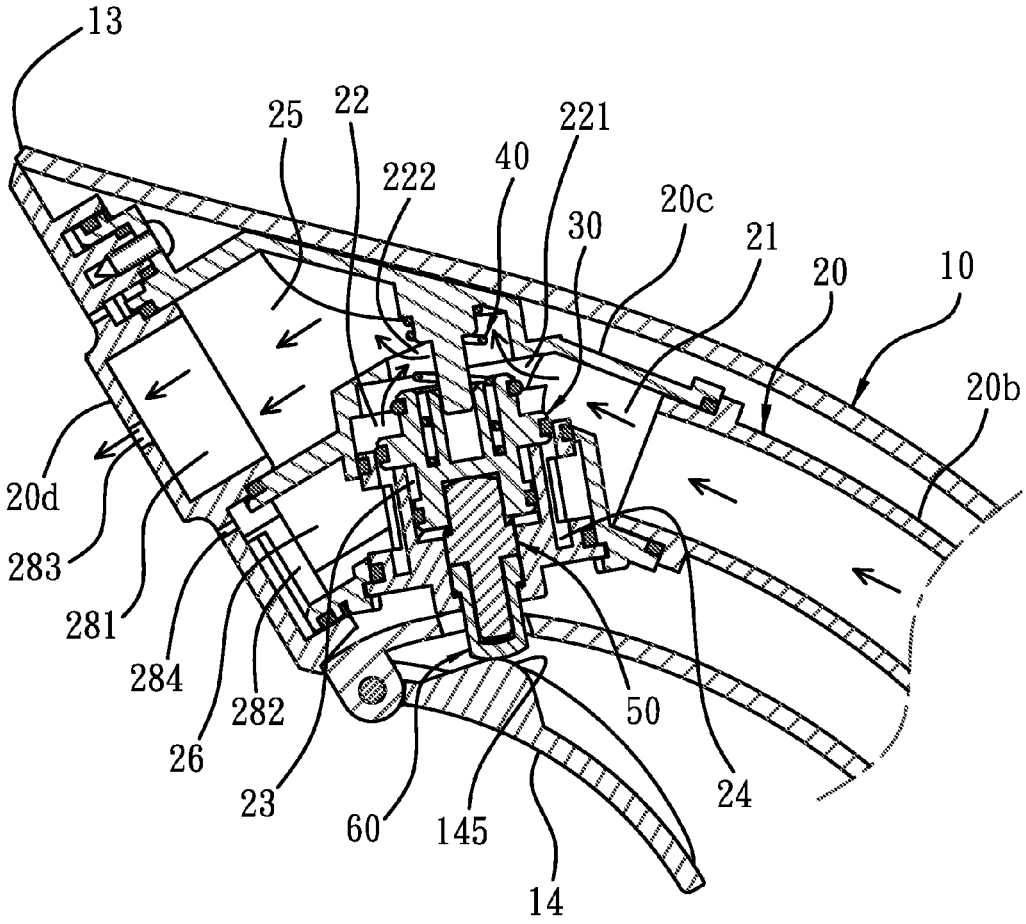
FIG. 11 is a cross sectional view showing the operation of the shower faucet in accordance with the preferred embodiment of the present invention.

The distributing valve core 30 includes a second closing portion 33 disposed on a bottom end of an outer peripheral wall thereof so that when the distributing valve core 30 is pushed downward to close the bore 241 of the seat 20*c*, and the second outlet 242 communicates with the second room 22 as shown in FIG. 11, wherein the second closing portion 33 is slid into the second room 22 above the bore 241, e.g., the outer rim 208 of the base 202 is located at the top end of the inner rim 209 to engage with of the inner rim 209 so as to close the bore 241.

The distributing valve core 30 includes a first coupling portion 34 disposed on the bottom end thereof to be received in the displace room 23 of the seat 20*c* to move vertically. The first coupling portion 34 is located above the ratchet members 232 to move, and includes a second sealing pad 35 retained on an outer wall thereof to engage with the displace room 23, and includes a connecting trough 341 mounted on a bottom end thereof to be pushed upward.

The distributing valve core 30 includes an annular fixing trough 36 fixed on a top end thereof and around the sleeve portion 31.

Figure 4:
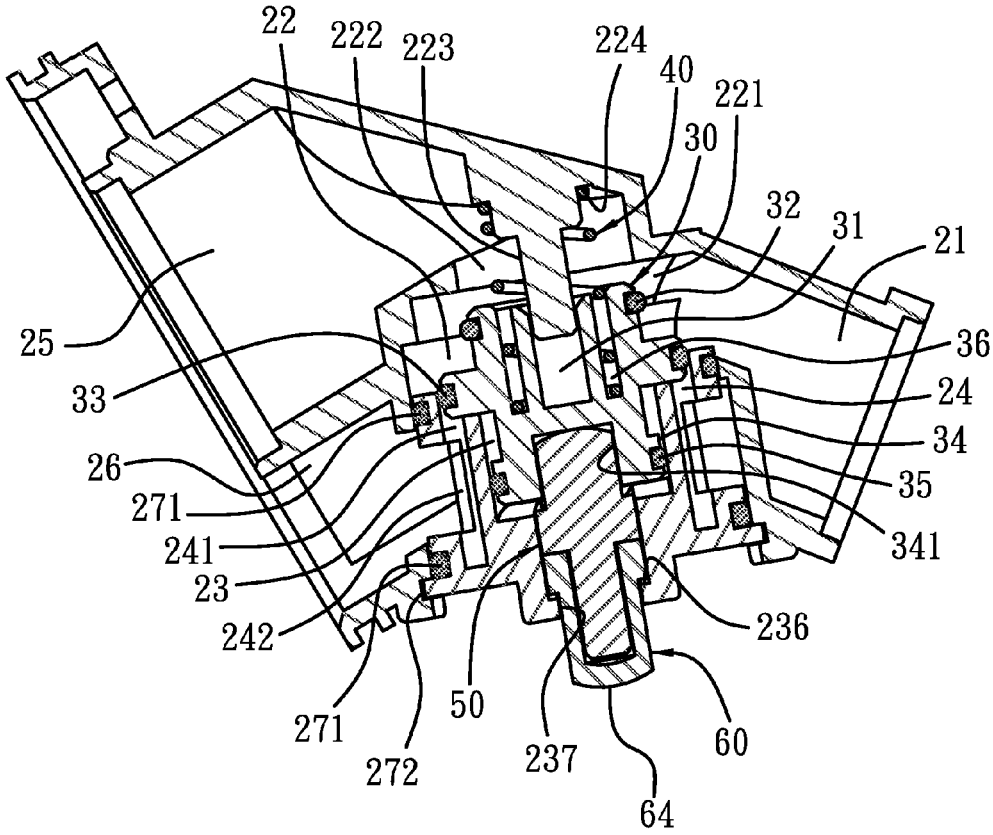
FIG. 4 is a cross sectional view showing the assembly of a seat of the shower faucet in accordance with the preferred embodiment of the present invention.
Figure 5:
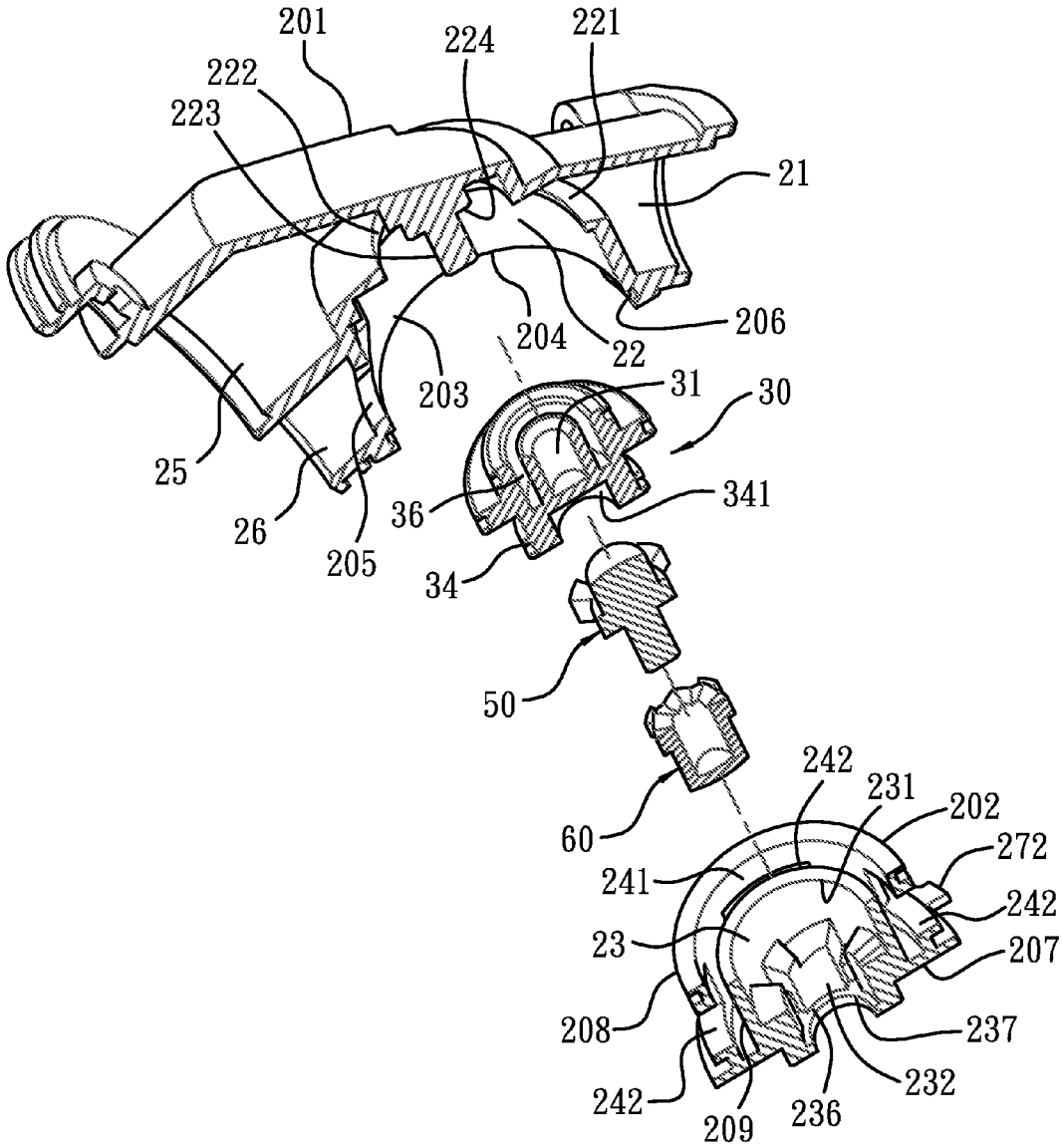
FIG. 5 is a perspective view showing the exploded components of the seat of the shower faucet in accordance with the preferred embodiment of the present invention.
Figure 6:
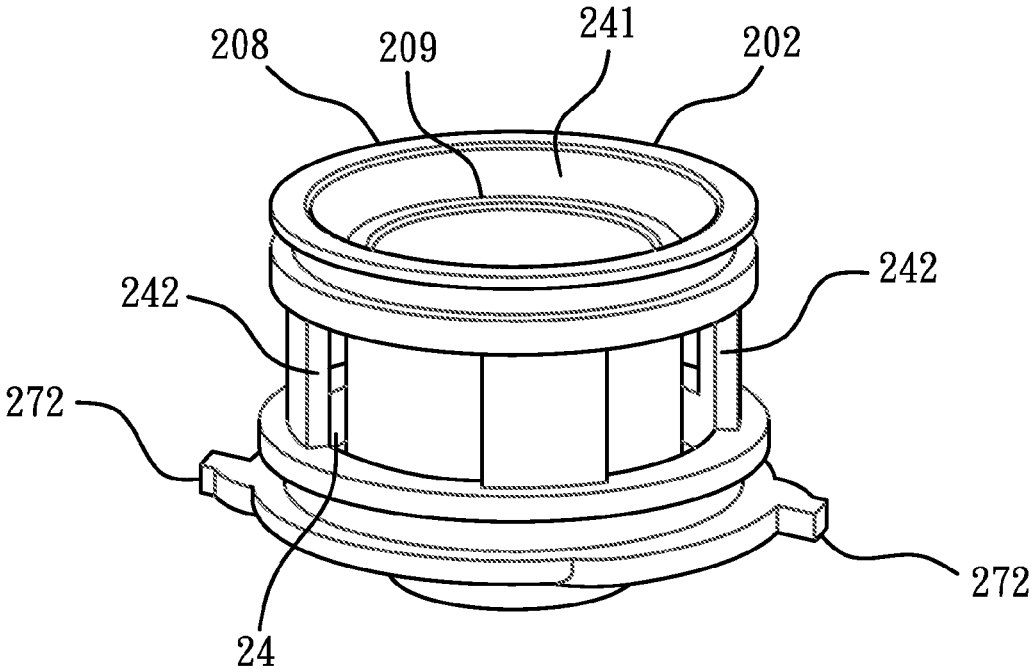
FIG. 6 is a perspective view showing the assembly of the seat of the shower faucet in accordance with the preferred embodiment of the present invention.

The resilient element 40 as shown in FIGS. 2 and 4, is a compression spring, and a top end of the resilient element 40 is fitted to the guiding portion 223 of the seat 20*c* and engages with the positioning fence 224, and a bottom end of the resilient element 40 is retained in the fixing trough 36 so that the distributing valve core 30 is pushed downward elastically.

Figure 8:
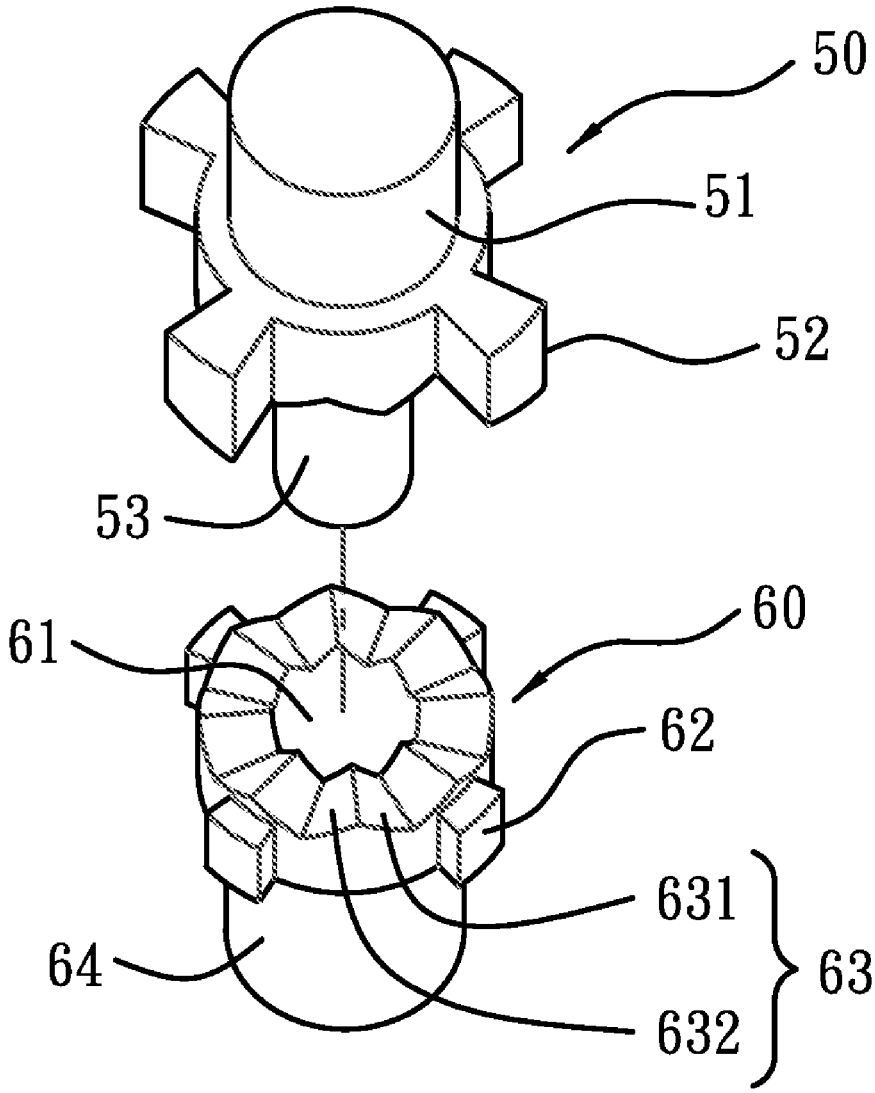
FIG. 8 is a perspective view showing the exploded components of a rotary positioning member and a button element of the shower faucet in accordance with the preferred embodiment of the present invention.
Figure 9:
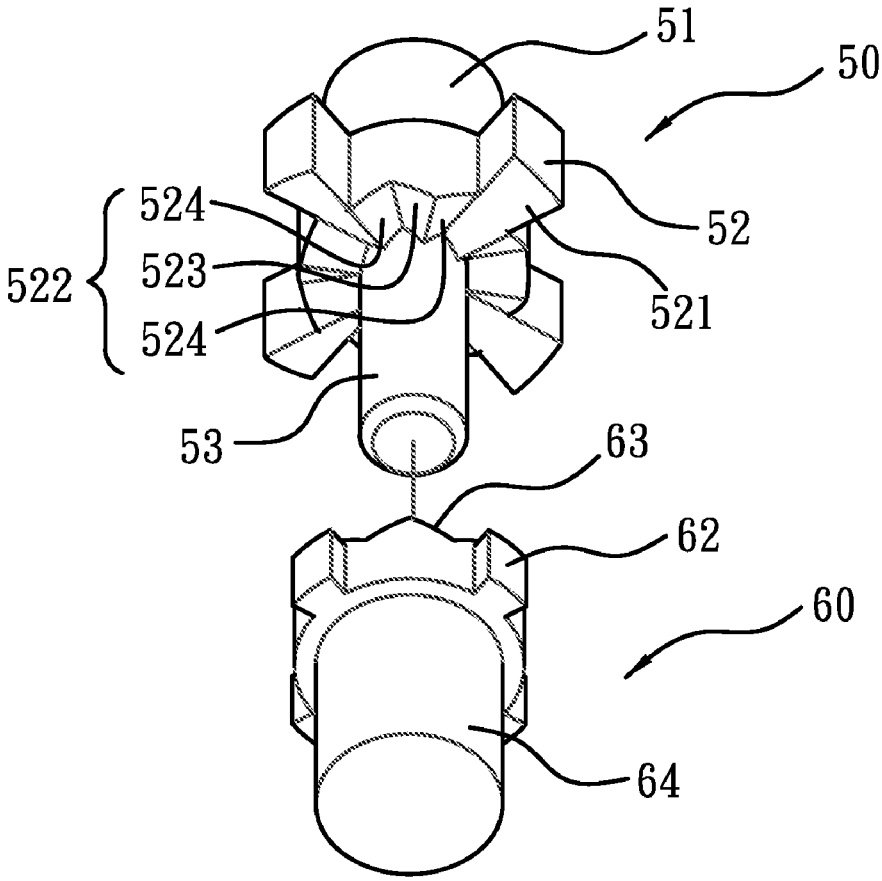
FIG. 9 is another perspective view showing the exploded components of the rotary positioning member and the button element of the shower faucet in accordance with the preferred embodiment of the present invention.
Figure 10:
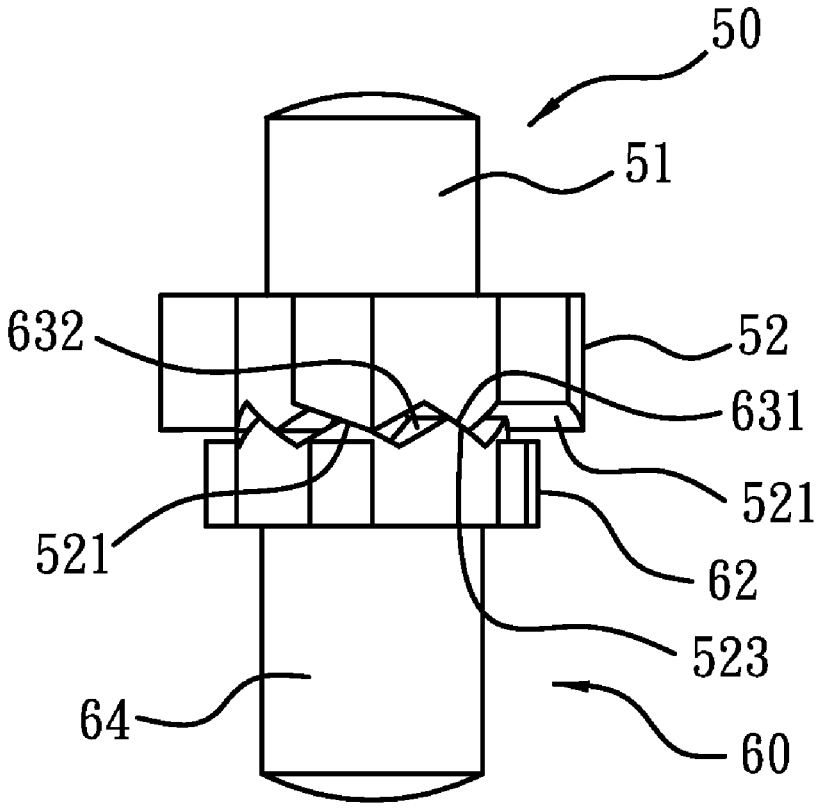
FIG. 10 is a plan view showing the operation of the rotary positioning member and the button element of the shower faucet in accordance with the preferred embodiment of the present invention.

The rotary positioning member 50 as illustrated in FIGS. 8-10, includes a second coupling portion 51 disposed on a top end thereof, and is a coupling shaft to fit with the connecting trough 341 of the first coupling portion 34 so as to abut against the distributing valve core 30 upward, and includes a number of engaging tooth members 52 mounted on a middle section thereof to slide vertically along the recesses 235 of the displace room 23 of the seat 20*c*, and each engaging tooth member 52 includes a first inclined tooth plane 521 fixed on a bottom end thereof.

The engaging tooth member 52 is pushed upward to disengage from the recess 235 so that the resilient element 40 pushes the rotary positioning member 50 via the distributing valve core 30, and the first inclined tooth plane 521 slides into the ratchet ditch 234 to be retained, such that the first closing portion 32 of the distributing valve core 30 is kept closing the first outlet 222, and when the engaging tooth member 52 is further pushed upward to disengage from the ratchet ditch 234, it is pushed by the resilient element 40 to rotate so as to disengage from the ratchet member 232 to move toward the axial recess 235. When the engaging tooth member 52 is not pushed upward anymore more, it is pushed by the resilient element 40 to move downward along the axial recess 235 so that the second closing portion 33 of the distributing valve core 30 is kept closing the bore 241.

The rotary positioning member 50 includes a fixing stem segment 53 extending from a bottom end thereof.

The button element 60 includes a hole 61 attached therein to fit the fixing stem segment 53 of the rotary positioning member 50, and includes a number of sliding members 62 secured on a top end of an outer wall thereof to slide vertically along the axial recesses 235 of the displace room 23.

Figure 12:
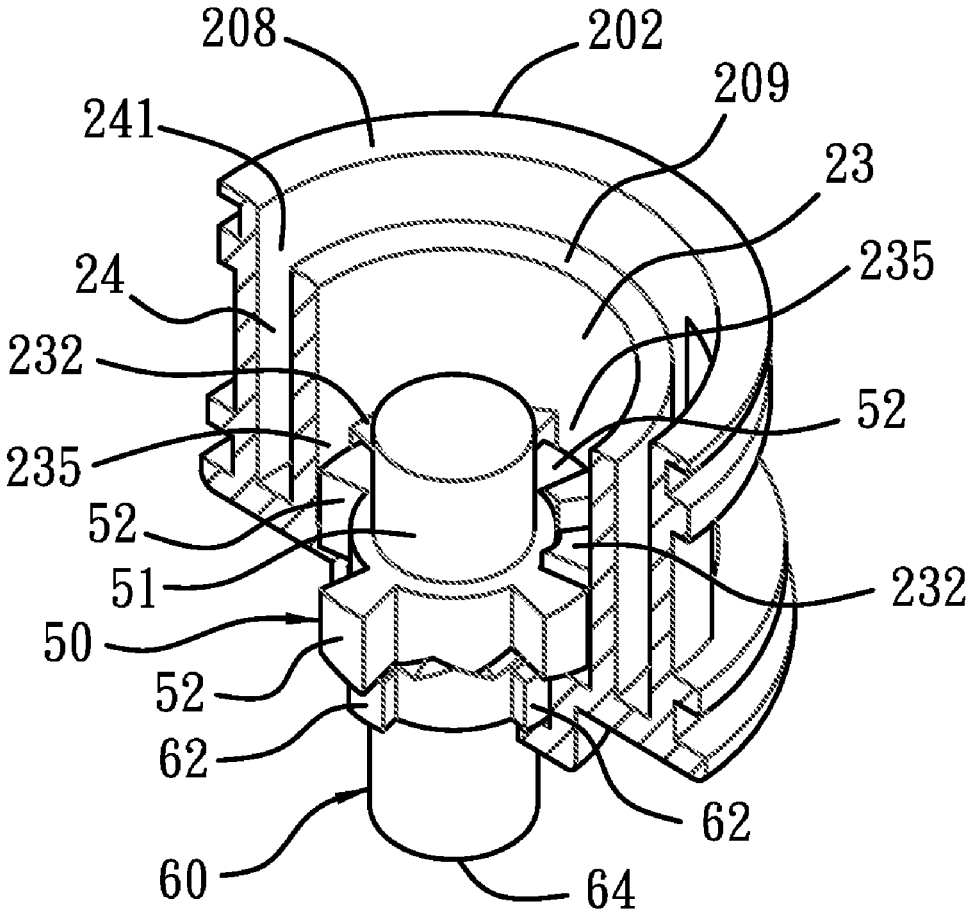
FIG. 12 is a perspective view showing the cross section of the assembly of the base, the rotary positioning member, and the button element of the shower faucet in accordance with the preferred embodiment of the present invention.

The button element 60 includes a plurality of conical teeth 63 arranged on the top end thereof to connect with each other, and the conical teeth 63 are located among the ratchet members 232, and each conical tooth 63 includes a third beveled surface 631 and a fourth beveled surface 632, wherein the third beveled surface 631 engages with the first inclined tooth plane 521 of the rotary positioning member 50 as shown in FIG. 12.

The button element 60 is axially limited to extend downward out of the aperture 237 of the displace room 23 by ways of an extension 64 which extends from a bottom end of an outer wall of the button element 60 as shown in FIG. 4. When the button element 60 moves downward, it engages with the bottom wall surface 236 of the aperture 237 of the displace room 23 by using the sliding member 62 to be retained axially.

Figure 13:
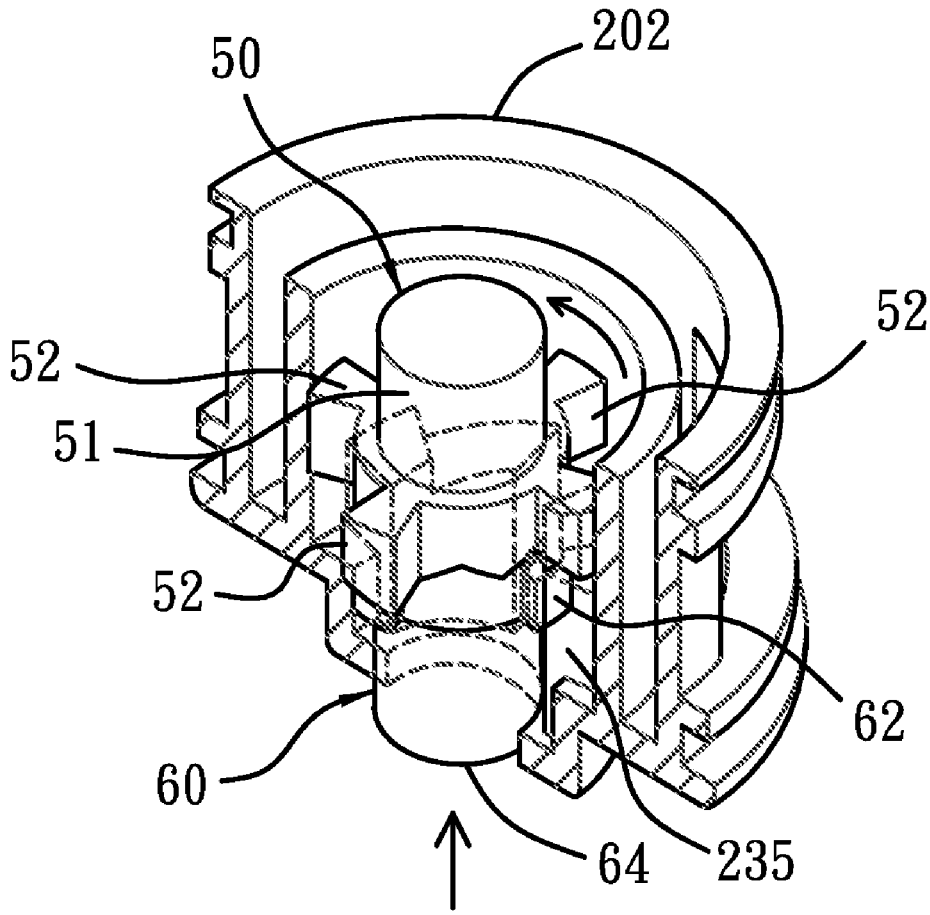
FIG. 13 is a cross-sectional perspective view showing the operation of the shower faucet in accordance with the preferred embodiment of the present invention.

The extension 64 of the button element 60 is pushed upward by the abutting block 145 which is rotated axially by the press bar 14 of the housing 10 so that the button element 60 slides upward, and the third beveled surface 631 is pushed upward to abut against the first inclined tooth planes 521 of the engaging tooth members 52 of the rotary positioning member 50 as illustrated in FIGS. 10 and 13 so that the rotary positioning member 50 is pushed to slide upward to further push the distributing valve core 30.

The third beveled surface 631 and the first inclined tooth plane 521 are arranged at the same tilted angle to engage with each other such that the third beveled surface 631 of the button element 60 is pushed to the first inclined tooth plane 521 smoothly, and the first inclined tooth plane 521 slides to the ratchet ditch 234.

Between the first inclined tooth planes 521 of the engaging tooth members 52 of the rotary positioning member 50 are defined a number of second inclined tooth planes 522 connecting with each other, wherein there are three second inclined tooth planes 522 provided in this embodiment as shown in FIGS. 9 and 10, and on a middle segment of the three second inclined tooth planes 522 is provided a first beveled surface 523, and two second beveled surfaces 524 are fixed adjacent to two sides of the first inclined tooth plane 521, tilted angles of the first beveled surface 523 and the first inclined tooth plane 521 are equal to contact with the third beveled surface 631 of the button element 60 to increase an abutting area between the rotary positioning member 50 and the button element 60.

When the press bar 14 is not pressed, water from the outlet pipe 20*b* flows into the second room 22 through the first room 21 and the inlet 221. Because, the distributing valve core 30 is located below the second room 22, and the first closing portion 32 disengages from the first outlet 222, the second closing portion 33 engages with the outer rim 208 so that the bore 241 are closed, such that water in the second room 22 is guided to the first outlet 222 to further flow into the central trench 281 of the watering disc 20*d* along the first watering cavity 25, and then the water flows out of the central vents 283 of the central trench 281 to generate the first watering as shown in FIG. 11, thereby feeding water to the bathtub.

The press bar 14 is used to switch different watering level, wherein when the press bar 14 is pressed, the abutting block 145 is actuated to press the button element 60, and then the button element 60 actuates the rotary positioning member 50 and the distributing valve core 30 to move upward, such that the first outlet 222 is closed by the first closing portion 32 of the distributing valve core 30, and the second closing portion 33 of the distributing valve core 30 disengages from the outer rim 208 of the base 202, the bore 241 communicates with the second room 22, hence the water in the second room 22 is guided to the bore 241 so as to flow into the peripheral trench 282 of the watering disc 20*d* along the flowing chamber 24, the second outlets 242, and the second watering cavity 26, and further flow out of the peripheral vents 284 of the peripheral trench 282 to generate the second watering as illustrated in FIG. 12, thus spraying showering water.

Thereby, when the press bar 14 is pressed to push the distributing valve core 30 to move above the second room 22, the second watering is generated, wherein the engaging tooth members 52 of the rotary positioning member 50 disengage from the axial recesses 235, and the first inclined tooth planes 521 of the engaging tooth members 52 rotate toward the ratchet ditch 234 as shown in FIG. 13, therefore when the press bar 14 is released, the first inclined tooth planes 521 engage with the ratchet ditches 234 so that the rotary positioning member 50 is retained at a higher position as shown in FIG. 14, and the distributing valve core 30 is abutted against by the rotary positioning member 50 so that a watering level of the second watering is kept without pressing the press bar 14 continuously, having easy operation.

Figure 15:
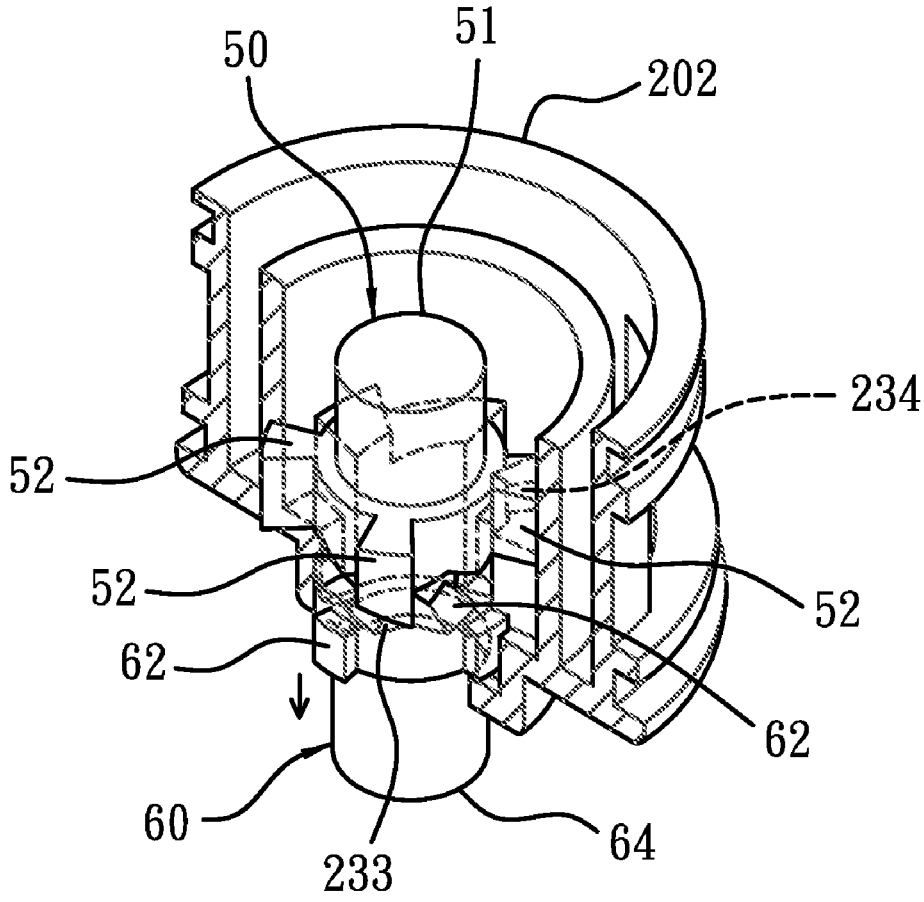
FIG. 15 is another cross-sectional perspective view showing the operation of the shower faucet in accordance with the preferred embodiment of the present invention.

When the rotary positioning member 50 is retained at the higher position and the press bar 14 is released, due to the button element 60 is not pushed by the resilient element 40 any more, it slides downward to a normal position as illustrated in FIG. 15.

If the press bar 14 is pressed once more, the engaging tooth members 52 of the rotary positioning member 50 disengage from the ratchet members 232, and after the press bar 14 is released, the engaging tooth members 52 of the rotary positioning member 50 slide in the axial recesses 235 to return back to a lower position so that the distributing valve core 30 is biased against by the resilient element 40 to move below the second room 22, generating the first watering. Thereby, the watering levels can be switched easily by pressing the press bar 14 repeatedly.

While we have shown and described various embodiments in accordance with the present invention, it is clear to those skilled in the art that further embodiments may be made without departing from the scope of the present invention.

What is claimed is:

1. A shower faucet comprising a housing including an internal chamber, an inlet end, and an outlet end, and including a press bar disposed on a peripheral wall thereof proximate to the outlet end to be pressed to rotate axially within a predetermined rotating angle;

a tube member installed in the housing, and including a fitting, an inlet pipe, a seat, and a watering disc, wherein the fitting is coupled with an output piping, the inlet pipe is screwed with the fitting;

a seat including a first room to flow water, a second room to distribute water, a displace room, a flowing chamber, a first watering cavity, and a second watering cavity; the first room including an inlet side to connect with an outlet end of the inlet pipe; the second room including an inlet fixed on one side thereof to communicate with the first room, and including a first outlet; a top end of the displace room communicating with a bottom end of the second room, and the displace room including a plurality of ratchet members extending on a lower side thereof, each ratchet member including two adjacent ratchet planes disposed on a top end thereof to define a ratchet ditch, and between any two abutting ratchet members beings defined an axial recess; the flowing chamber being fixed in the displace room and including a bore attached on a top end thereof to communicate with a peripheral side of the bottom end of the second room, and including at least two second outlets arranged around a peripheral side thereof; the first watering cavity communicating with the second room through the first outlet; the second watering cavity communicating with the flowing chamber through the second outlets;

the watering disc engaging with a watering side of the seat, and including a central trench and a peripheral trench mounted on an inner side thereof, the central trench being in communication with the first watering cavity of the seat to obtain a first watering, and the peripheral trench being in communication with the second watering cavity of the seat to achieve a second watering;

the distributing valve core installed in the second room of the seat, and including a first closing portion retained on a top end of an outer wall thereof to close the first outlet of the seat when the distributing valve core is pushed upward to slide, and the bore being in communication with the second room; the distributing valve core also including a second closing portion disposed on a bottom end of an outer peripheral wall thereof so that when the distributing valve core is pushed downward to close the bore of the seat, and the second outlet communicates with the second room;

the resilient element installed at a top end of the distributing valve core relative to a top end of the second room of the seat so as to push the distributing valve core downward;

the rotary positioning member allowing to push the distributing valve core upward, and including a number of engaging tooth members mounted on a middle section thereof to slide vertically along the recesses of the displace room of the seat, and each engaging tooth member including a first inclined tooth plane fixed on a bottom end thereof; wherein the engaging tooth member is pushed upward to disengage from the recess so that the first inclined tooth plane slides into the ratchet ditch to be retained, such that the first closing portion of the distributing valve core is kept closing the first outlet, and when the engaging tooth member is further pushed upward to disengage from the ratchet ditch, it is pushed by the resilient element to rotate so as to disengage from the ratchet member to move toward the axial recess, and when the engaging tooth member is not pushed upward anymore more, it is pushed by the resilient element to move downward along the axial recess so that the second closing portion of the distributing valve core is kept closing the bore;

a button element including a number of sliding members secured on a top end of an outer wall thereof to slide vertically along the axial recesses of the displace room, and including a plurality of conical teeth arranged on the top end thereof to connect with each other, and each conical tooth including a first beveled surface and a second beveled surface, the button element being axially limited to extend downward out of a bottom end of the displace room by ways of an extension which extends from a bottom end of an outer wall of the button element, the extension of the button element being pushed upward by the abutting block which is rotated axially by the press bar of the housing so that the button element slides upward, and the first beveled surface being pushed upward to abut against the first inclined tooth planes of the engaging tooth members of the rotary positioning member.

2. The shower faucet as claimed in claim 1, wherein the seat is comprised of a body and a base; the body is one part of the first room, the second room, the first watering cavity, the second watering cavity, the inlet, the first outlet, and the guiding portion, and includes a receiving space formed on a lower side of the second room, and the receiving space includes a first opening formed on a bottom end thereof, includes a second opening arranged on one side thereof to communicate with the second watering cavity; the base is installed in the receiving space of the body, and includes a bottom rim, and an outer rim and an inner rim, both of which extend upward from the bottom rim; the outer rim includes two first sealing pads respectively retained on a top and a bottom ends of an outer peripheral side thereof to engage with inner walls of an upper and a lower sides of the receiving space of the body, between the inner rim and the bottom rim is defined the displace room of the seat; a top end of the inner rim is lower than the outer rim, and among the inner rim, the outer rim, and the bottom rim is defined the flowing chamber so that the bore is defined by the inner rim and the outer rim, and the second outlets are defined by a plurality of annular mouths arranged on a middle section of the outer rim; an internal vacancy of the outer rim below the top end of the inner rim is used to form another part of the second room and to form the complete second room with an inner vacancy of the body.

3. The shower faucet as claimed in claim 2, wherein the first opening of the body includes two retaining slots symmetrically attached on a peripheral side of a bottom end thereof; and the outer rim of the base includes two locking members disposed on an outer wall thereof in response to the first sealing pads individually to retain with the retaining slots so that the base is fixed in the body.

4. The shower faucet as claimed in claim 2, wherein the first and the second closing portions of the distributing valve core are a sealing pad; the first closing portion is slid into the first outlet to engage with an inner peripheral wall of the first outlet so as to close the first outlet; the second closing portion is slid into the second room above the bore to engage with of the inner rim so as to close the bore.

5. The shower faucet as claimed in claim 1, wherein the second room includes a guiding portion secured on the top end thereof, and the distributing valve core includes a sleeve portion formed on a top end thereof to slide vertically along the guiding portion.

6. The shower faucet as claimed in claim 5, wherein the guiding portion is formed in a rod shape, and the sleeve portion is formed in a sliding groove to slide vertically along the guiding portion.

7. The shower faucet as claimed in claim 1, wherein the second room includes a positioning fence attached around the guiding portion; the distributing valve core includes an annular fixing trough fixed on the top end thereof and around the sleeve portion; the resilient element is a compression spring, and a top end of the resilient element engages with the positioning fence, and a bottom end of the resilient element is retained in the fixing trough.

8. The shower faucet as claimed in claim 1, wherein the distributing valve core includes a first coupling portion disposed on the bottom end thereof to be received in the displace room of the seat to move vertically; the rotary positioning member includes a second coupling portion disposed on a top end thereof to connect with the first coupling portion.

9. The shower faucet as claimed in claim 8, wherein the first coupling portion includes a connecting trough mounted on a bottom end thereof; the second coupling portion is a coupling shaft to fit with the connecting trough of the first coupling portion.

10. The shower faucet as claimed in claim 1, wherein the displace room also includes a bottom wall surface mounted on the bottom end thereof, and the bottom wall surface includes an aperture fixed on a central portion thereof so that the extension of the button element extends through the aperture, and when the button element moves downward, it engages with the bottom wall surface of the aperture of the displace room by using the sliding member to be retained axially.

11. The shower faucet as claimed in claim 1, wherein the first beveled surface and the first inclined tooth plane are arranged at the same tilted angle to engage with each other.

12. The shower faucet as claimed in claim 1, wherein the rotary positioning member includes a fixing stem segment extending from a bottom end thereof; the button element includes a hole attached therein to fit the fixing stem segment of the rotary positioning member.

13. The shower faucet as claimed in claim 1, wherein between the first inclined tooth planes of the engaging tooth members of the rotary positioning member are defined three second inclined tooth planes, and on a middle segment of the three second inclined tooth planes is provided a first beveled surface, and two second beveled surfaces are fixed adjacent to two sides of the first inclined tooth plane, tilted angles of the first beveled surface and the first inclined tooth plane are equal to contact with the third beveled surface of the button element.

* * * * *